US005472579A

United States Patent [19]

Mabuchi et al.

[11] Patent Number: 5,472,579

[45] Date of Patent: Dec. 5, 1995

[54] HOT-ROLLED STEEL STRIP MANUFACTURING AND DESCALING METHOD AND APPARATUS

[75] Inventors: Katsumi Mabuchi, Hitachi; Masahiro Itoh, Hitachioota; Eizi Kashimura, Naka; Tsuneo Nakamura, Hitachi, all of Japan

[73] Assignee: Hitachi, Ltd., Tokyo, Japan

[21] Appl. No.: 289,267

[22] Filed: Aug. 11, 1994

[30] Foreign Application Priority Data

Sep. 17, 1993 [JP] Japan ..... 5-231255

[51] Int. Cl.[6] ..... C25F 1/06; C25F 7/00

[52] U.S. Cl. ..... 204/145 R; 204/206; 204/209; 204/210

[58] Field of Search ..... 204/145 R, 129.75, 204/129.1, 206–209, 210

[56] References Cited

U.S. PATENT DOCUMENTS

| | | | |
|---|---|---|---|
| 3,536,601 | 10/1970 | Hill et al. | 204/145 RX |
| 3,627,665 | 12/1971 | deLaminne | 204/209 |
| 4,129,485 | 12/1978 | Shikata et al. | 204/145 RX |
| 4,178,194 | 12/1979 | Azzerri et al. | 204/129.43 X |
| 4,994,157 | 2/1991 | Itoh et al. | 204/145 R |
| 5,202,002 | 4/1993 | Tsuchinaga et al. | 204/145 R |

OTHER PUBLICATIONS

"Mitsubishi Heavy Industry Technique", vol. 29, No. 1 (1992–1) pp. 24 to 29.

"Hitachi Review", vol. 67, No. 4 (1985–4) pp. 41 to 46.

"Mitsubishi Heavy Industry Technique", vol. 2, No. 3 (1965) pp. 289 to 297.

*Primary Examiner*—Donald R. Valentine

*Attorney, Agent, or Firm*—Evenson McKeown Edwards & Lenahan

[57] ABSTRACT

This invention provides a method and an apparatus for removing scales from hot-rolled steel strips to produce steel strips with excellent surface conditions. In a pickling facility to pickle the hot-rolled steel strip, the pickling method of this invention passes an electric current through the continuously fed, hot-rolled steel strip in one or more of a plurality of pickling tanks. A means to supply an electric current is also provided.

37 Claims, 8 Drawing Sheets

| PICKLING METHOD | IMMERSION (DEEP BATH) | CATENARY (4 TANKS) | INVENTION (ONLY 1 TANK ELECTROLYZED) | JET FLOW |
|---|---|---|---|---|
| PICKLING SPEED (m/min.) | 178 | 285 | 518 | 407 |

HOT-ROLLED STEEL STRIP MANUFACTURING AND DESCALING METHOD AND APPARATUS

BACKGROUND OF THE INVENTION

1. Field of the Invention

The present invention relates to a method of manufacturing steel sheets and more particularly to a descaling method of removing oxide scales formed on the surface of hot-rolled steel strips at high speed and an apparatus thereof.

2. Description of the Prior Art

Generally, steel sheets (carbon steel) are rolled at temperatures of 800°–900° C. and thus black oxide scales mainly of $Fe_3O_4$ form on the their surfaces. The scales may damage the surface of the steel sheet in the subsequent cold rolling process and therefore must be removed. As the demand for automotive thin steel sheet is currently increasing, the descaling at high speed is becoming increasingly important.

The conventional descaling methods for steel strips are classified largely into a chemical and a mechanical method. The mainstream of the chemical method is a catenary pickling method, which involves immersing and continuously passing steel plates through tanks of acid solution to remove scales from the steel sheets by chemical reactions. Among methods having an enhanced efficiency of descaling oxides by immersing in acid solution are a box dam method and a jet flow method. The box dam method consists in filling a rectangular parallelepiped container with acid solution and passing steel plates through it for pickling. The rectangular parallelepiped container has weirs installed at the upper and lower surfaces thereof. The jet flow method, as described in the Mitsubishi Juko Giho (Mitsubishi Heavy Industry Technique) Vol. 29, No. 1 (1992-1), has a jet nozzle installed in the box dam structure, whereby acid solution is sprayed against the steel sheet to further enhance the oxide scale removing effect.

The mechanical descaling methods include a rolling method, a polishing method, a shot blast method and a repetitive bending method, all introduced in the Hitachi Hyoron (Hitachi Review) Vol. 67, No. 4 (1985-4) as new technologies for high-speed descaling facilities. Also available are a high-pressure water spray method, a mechanical and pickling combination method, and an ultrasonic pickling method introduced in the Mitsubishi Juko Giho Vol. 2, No. 3, p. 289 (1965).

The conventional pickling for steel strips uses a dilute hydrochloric acid (HCl) because iron oxides easily dissolve in it. The reactions that occur are expressed by $$Fe_2O_3+6HCl \rightarrow 2FeCl_3+3H_2O \quad \text{(Reaction 1)}$$

$$Fe_3O_4+8HCl \rightarrow FeCl_2+2FeCl_3+4H_2O \quad \text{(Reaction 1)}$$

To speed up the descaling of oxides, the reactions (1) and (2) need be accelerated. Because this method utilizes a chemical dissolution reaction of the oxide scale, a generally conceivable method for efficient descaling may be by increasing the acid concentration and temperature to accelerate the reaction. The increase in the acid concentration and temperature, however, is in reality restricted by a cost of acid disposal processing, problems involving environment and facility, and the surface quality, and it is difficult to increase the acid concentration and temperature from the current level. The pickling process involves continuously immersing the steel strips in a plurality of acid baths. In the first tank of acid solution it is difficult to raise the temperature of the steel strips to a sufficiently high level. Moreover, the first tank has the lowest acid concentration. Because of these factors and a time lag before the scale dissolution begins, the first tank has an inherent problem of extremely low pickling efficiency.

To increase the pickling speed, improvements have been made over the conventional box weir method and jet flow method, whereby agitation is introduced to reduce the temperature boundary layer and thereby accelerate heat conduction to steel sheets and at the same time replenish a liquid close to the steel sheet surface efficiently. These improved methods, however, are still unable to raise the oxide scale removing efficiency at the initial stage of the pickling and it is difficult to improve the speed of descaling the oxides. In either case, when the speed at which the steel sheets are passed through the acid solution is low, the oxide scales can be removed. But as the pass-through speed is increased, the perfect descaling cannot be obtained.

Other conventional techniques include a method in which an electrolysis is performed to a stainless steel in a sulfuric acid, nitric acid, neutral salt or molten salt to increase the dissolution speed. Because the oxide scale of the steel strip is about two orders of magnitude thicker than that of the stainless steel, the direct application of a technique developed for the stainless steel to the steel strip cannot remove the oxide scales completely. In the case of the stainless steel, for the purpose of accelerating the dissolution of chrome oxide, the indirect current application method has a major part of the stainless steel strip used as an anode and minimizes the cathode portion that does not accelerate the dissolution reaction. This is because the cathode reaction causes the chrome oxide to precipitate again. At the anode, however, a base material may also dissolve. If these methods are applied to the removing of oxide scales from the steel strips, the surface of the steel strip cannot be kept smooth, making it impossible to manufacture high-quality products.

SUMMARY OF THE INVENTION

An object of this invention is to provide a method and an apparatus for removing oxide scales at high speed and a descaled steel strip with an excellent surface smoothness.

The above-mentioned objective can be achieved by increasing the dissolving speed of scales of the steel strip in a dilute hydrochloric acid solution that has the lowest temperature among the pickling tanks containing dilute hydrochloric acid solutions heated to higher than 60° C. or more specifically to higher than 70° C. (the first acid-washing tank where the steel strip is immersed in the HCl solution). This invention is characterized in that a dilute hydrochloric acid solution heated to higher than 60° C. or more specifically to 70°–95° C. is used and that the dilute hydrochloric acid solution is moved from downstream to upstream side with respect to the direction in which the steel strip is passed through the acid solution in order to increase the dissolving speed of scales of the steel strip immersed in the lowest-temperature dilute hydrochloric acid solution on the upstream side. Flowing the acid solution from downstream to upstream side increases the contact speed between the acid solution and the steel strip.

In more concrete terms, in a process of pickling a steel strip having oxide scales by using an HCl solution, the above objective is realized by a method wherein an electric current is passed through the steel strip between electrode plates provided to a series of pickling tanks, and by an oxide scale removing apparatus for steel strips which is equipped with electrolytic pickling tanks having anode and cathode electrodes to implement this method. An electric current can be passed through the steel strip either by a direct current application method wherein a current is applied between electrodes provided to the steel strip with the steel strip itself used as electrodes, or by an indirect current application method wherein a current is applied between a plurality of electrodes installed on the steel strip. In this case, it is preferred to control the current density at 20 A/dm$^2$ or more particularly at 5–10 A/dm$^2$to prevent generation of an excess amount of gas by the acid solution being electrolyzed and to prevent the steel strip from being overheated by Joule heat. The voltage is set at about 1.2 V.

In the oxide scale removing apparatus for hot-rolled steel strips, enhancing the oxide scale removing efficiency and producing a steel strip with an excellent surface smoothness can be realized by using the major part of the steel strip as an anode in the initial stage and, in the later stage as a cathode.

Further, in the above oxide scale removing apparatus for hot-rolled steel strips, the above objective can be achieved by using insoluble electrodes arranged opposite to the continuously moving steel strip to pass an electric current through the steel strip.

By implementing the above method with the above apparatus, it is possible to easily produce at high speed a steel strip virtually completely removed of oxide scales and having an excellent surface smoothness.

In a hot-rolled steel strip manufacturing method involving hot-rolling a mild steel by a hot-rolling machine to produce a steel strip and bringing the steel strip into contact with an acid solution to remove scales formed on the surface of the steel strip, the present invention provides a hot-rolled steel strip manufacturing method, which consists of: keeping at more than 60° C. the dilute acid hydrochloric acid solution in a plurality of pickling tanks through which the steel strip coming out of the rolling machine is passed; moving the dilute hydrochloric acid solution from downstream to upstream side with respect to the direction of steel strip movement; supplying an electric current to the steel strip; and moving the steel strip from upstream to downstream side to pickle the steel strip. In the above manufacture method, an electric current is preferably passed through the steel strip in the pickling tank situated on the upstream side. Further, a current is preferably supplied to the steel strip passing through the pickling tank that contains the lowest-temperature dilute hydrochloric acid solution. Furthermore, it is preferred to supply an electric current to the steel strip while forcibly supplying an acid solution over both sides of the steel strip being treated.

Before or after the acid solution is forcibly supplied over both sides of the steel strip, an electric current may be applied to the steel strip. It is preferred to apply an electric current with a current density of 5–10 A/dm$^2$ on both sides of the steel strip.

In a descaling method of pickling hot-rolled steel strips, this invention provides a descaling method for hot-rolled steel strips, which comprises the steps of: keeping the dilute hydrochloric acid solution in a plurality of pickling tanks at more than 60° C.; moving the dilute hydrochloric acid solution from downstream to upstream side with respect to the direction of movement of the steel strip; supplying an electric current to the steel strip; and moving the steel strip from upstream to downstream side to pickle the steel strip. In this method, it is preferred to supply an electric current to the steel strip in the pickling tank on the upstream side. Further, a current is preferably supplied to the steel strip passing through the pickling tank that contains the lowest-temperature dilute hydrochloric acid solution. It is effective to supply an electric current to the steel strip while forcibly supplying an acid solution over both sides of the steel strip being treated.

This invention provides a descaling facility for hot-rolled steel strip, which comprises: a plurality of pickling tanks containing a dilute hydrochloric acid solution kept at more than 60° C.; a means to move the dilute hydrochloric acid solution from downstream to upstream side of the direction of movement of the steel strip; a means to move the steel strip from an upstream tank to a downstream tank; and a means to supply an electric current to the steel strip. In this invention, the continuous pickling facility for the hot-rolled steel strip can be provided with a means to supply an electric current to the steel strip passing through the acid solution. It is possible, of course, to provide a means that indirectly applies an electric current to the moving steel strip through anode and cathode electrodes installed in the pickling tank. It is also possible to provide a means that directly applies an electric current to the moving steel strip by arranging a cathode electrode or an anode electrode opposite to the steel strip and using the steel strip as the anode electrode or cathode electrode. It is preferred that the last electrode in each tank or bath through which the steel strip passes be made an anode electrode. The electrode that the steel strip passes can have at least one of the area, length and number of its anode electrodes increased toward the downstream side of the pickling process.

This invention provides a descaling facility for hot-rolled steel strips, which comprises: a means to feed a steel strip rolled by a hot-rolling machine; a means to cut the steel strip to arbitrary lengths; a means to apply mechanical stresses to scales formed on the steel strip; a plurality of tanks containing an acid solution that contacts the steel strip; a means to move the steel strip through the plurality of tanks while keeping it immersed in the acid solution; a means to heat the acid solution to more than 60° C.; a means to move the acid solution from downstream to upstream side of the movement of the steel strip; a means to supply an electric current to the steel strip; a means to water-wash the treated steel strip coming out of the tank; and a means to dry the water-washed steel strip. In this invention the electric supply means can be provided on the upstream side of the movement of the steel strip. The heating means and the acid solution moving means can be installed in a system that bypasses from the group of tanks.

Further, this invention provides a continuous pickling and cold-rolling method and an apparatus therefor, by which a steel strip is descaled by pickling and subsequently cold-rolled. Because the hot-rolled steel strip can be formed into a thin sheet by the continuous casting, it is possible to directly perform the hot-rolling operation and also the subsequent descaling operation. This continuous process or apparatus are necessary for the subsequent cold-rolling process.

In the process where a steel strip heated to high temperatures is rolled by a hot-rolling machine, the oxide scales formed on the surface of the steel strip consist of three phases—an FeO (wustite), an $Fe_2O_3$ (hematite) and an $Fe_3O_4$ (magnetite). During the cooling process the wustite for the most part will dissolve into magnetite. The dissolving reactions of the oxide scales in the hydrochloric acid are expressed by (Reaction 1) and (Reaction 2). To accelerate these reactions, an electrolysis was used in combination to pass an electric current. In the cathode region, the iron oxide, unlike chrome oxide, undergoes electrochemical dissolution reactions expressed by (Reaction 3) and (Reaction 4), accelerating the dissolution reactions based on the chemical reaction of iron oxide expressed by (Reaction 1) and (Reaction 2). That is, electrons are supplied from external circuits to the oxide scales, which then undergo the dissolution reactions.

$$Fe_2O_3+6H^++2e\rightarrow 2Fe^{2+}+3H_2O \quad \text{(Reaction 3)}$$

$$Fe_3O_4+8H^++2e\rightarrow 3Fe^{2+}+4H_2O \quad \text{(Reaction 4)}$$

Because the base material of the steel strip is a cathode, the iron does not dissolve at all, preventing the surface of the steel strip from being roughened. In the anode region, the iron dissolution reaction occurs as expressed by (Reaction 5).

$$Fe\rightarrow Fe^{2+}+2e \quad \text{(Reaction 5)}$$

The electrons released in this reaction are supplied to the oxide scales, which dissolve by the reaction given by (Reaction 3) and (Reaction 4). In this case, because the base material of the steel strip is anode, iron dissolves resulting in roughened surface of the steel strip.

The time it takes for the oxide scales to be dissolved by the ordinary immersion in hydrochloric acid is several times shorter when the cathode electrolysis is used in combination than when it is not. Comparison between the oxide scale dissolution reactions in the anode region and the cathode region has found that in the initial stage of immersion where there are large amounts of oxide scales, the dissolution reaction of the oxide scales is faster in the anode region but that in the later stage of immersion where there are fewer oxide scales, the dissolution reaction's relationship reverses. Therefore, in the process of pickling in the HCl solution the steel strip with oxide scales formed thereon, it is possible to improve the oxide scale removing efficiency by making the steel strip an node by electrolysis in an initial stage of a series of pickling tanks and by making the steel strip a cathode by electrolysis in a later stage of the pickling tanks. To save energy, however, this invention improves the descaling efficiency by increasing the temperature of either the steel strip or the acid solution at the inlet of the steel strip pickling apparatus.

In the case of indirect current application, when only the first of the series of pickling tanks is to be electrolyzed, anode electrodes are arranged in the first half of the tank and cathode electrodes in the latter half. When electrolysis is to be performed in two or more of the series of the tanks, the number of cathode electrodes is progressively reduced and the number of anode electrodes increased toward the final stage of the acid-washing process.

This invention improves the speed of pickling, which is low in prior art. The invention also helps eliminate imperfect removing of oxide scales, as has been experienced with the conventional mechanical descaling, thereby significantly improving the descaling speed, efficiency and performance.

This invention allows oxide scales to be removed swiftly from the hot-rolled steel strip and also produces a steel strip with an excellent surface quality.

DESCRIPTION OF THE PREFERRED EMBODIMENTS

Embodiment 1

Figure 1:
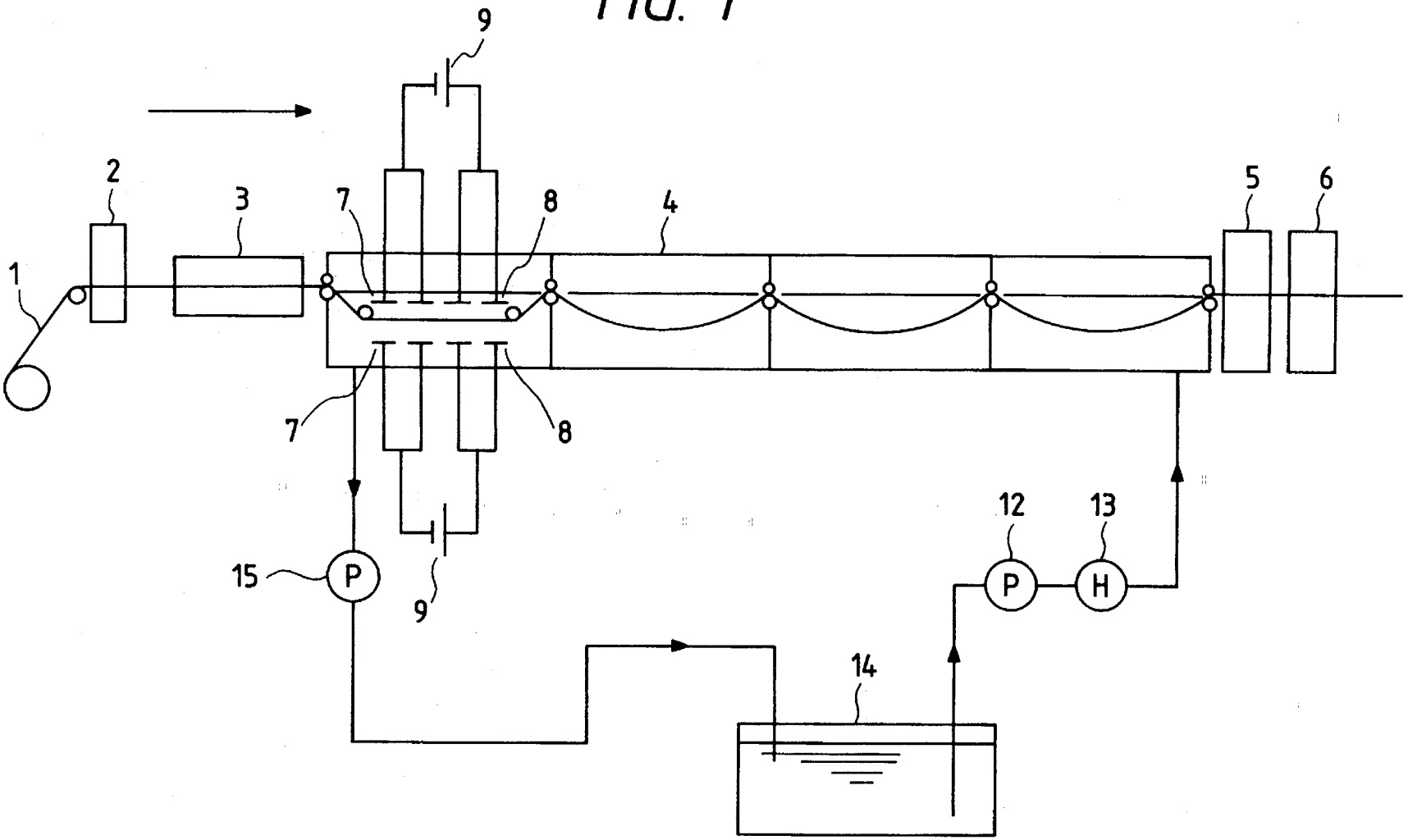
FIG. 1 is a schematic diagram showing a descaling process as one embodiment of this invention.

Now, embodiments of this invention will be described by referring to the accompanying drawings. FIG. 1 shows an example method for removing oxide scales formed on a steel strip 1, as one embodiment of this invention.

The hot-rolled steel strip 1 having oxide scales formed on the surface thereof during the hot-rolling process is passed through a shear 2 and a scale breaker 3 and introduced into a pickling bath or tank 4 consisting of four tanks. A first tank is set to have a hydrochloric acid concentration of 1.5% and a temperature of 70° C., a second tank 3% and 95° C., a third tank 5% and 95° C., and a fourth tank 7% and 95° C. The dilute hydrochloric acid solution is controlled in concentration by a reserve tank 14 and delivered by a pump 12. It is heated to about 95° C. by a heater 13. The hydrochloric acid solution is moved from the fourth tank toward the first tank while descaling the steel strip, and is drawn out from the first tank by a pump 15.

Figure 2:
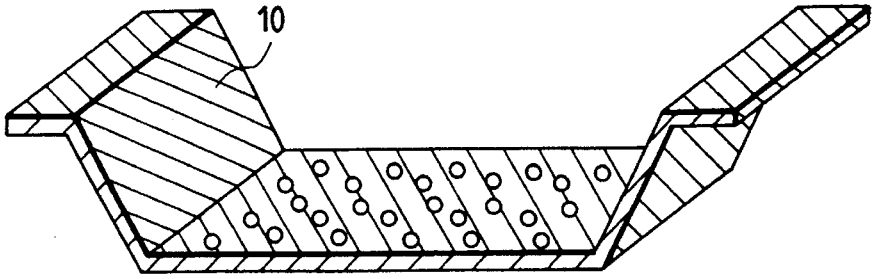
FIG. 2 is a perspective view showing the structure of an electrode used in the descaling process of this invention.

Because the temperature and acid concentration in the first tank are both low, its pickling efficiency is the lowest among the four tanks 4 if the steel strip is subjected to only a simple immersion. So, the first tank employs an electrolysis, too. A plurality of electrodes are arranged facing the steel strip 1 and a DC current is applied between the electrodes. The DC current is supplied by a DC power source 9 and passed indirectly through the steel strip 1. To increase the pickling efficiency, cathode electrodes 7 are installed in the first half of the tank to make the steel strip 1 an anode and, in the second half, anode electrodes 8 are arranged to make the steel strip 1 a cathode and thereby prevent the base of the steel strip 8 from becoming rough. Then, the steel strip 1 is passed through the second, third and fourth tanks, in that order, during which time the oxide scales are removed. The second, third and fourth tanks have higher temperatures and acid concentrations than those of the first tank, so that their pickling efficiencies are equal to or better than that of the first tank. An example construction of an electrode used in the first tank is shown in FIG. 2. The electrodes are non-soluble electrodes such as titanium-palladium or titaniumplatinum covered plates because they are used in an acid solution. The cathodes used for electrolysis, however, need not be covered with precious metals such as palladium and platinum because they are given an anti-corrosion treatment. The surface of the electrode facing the steel strip is formed with a plurality of holes to efficiently release oxygen or hydrogen gas generated by electrolysis. With this construction, it is possible to reduce the real electrode area while keeping wide the electrolyzing area facing the steel strip and increase the current density.

To minimize a loss current that directly flows between the cathode and the anode, not passing through the steel strip, the surfaces of the electrode that do not face the steel strip are covered with an insulating material 10 such as teflon. This treatment enables the oxide scales formed by the hot-rolling to be removed with high efficiency and at high speed. After having been removed of the hydrochloric acid from its surface in the water-washing tank 5, the steel strip 1 is dried by a drier 6.

Figure 3:
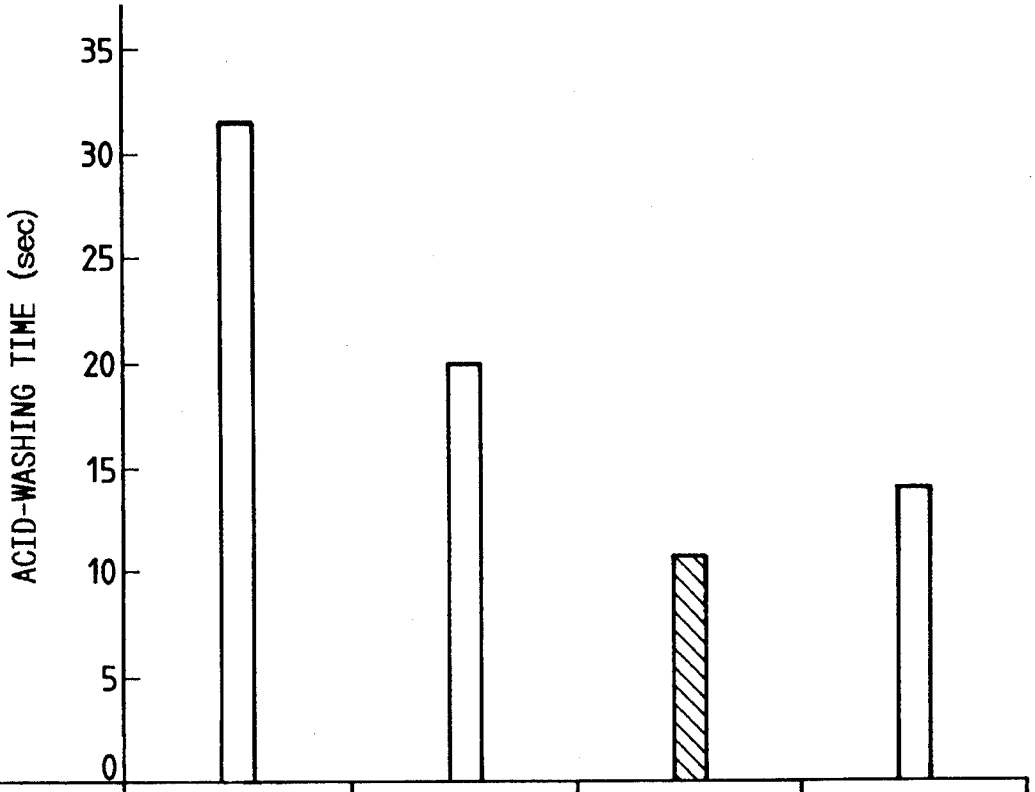
FIG. 3 is a graph showing comparison between the pickling times of this invention and the conventional methods.

FIG. 3 shows comparison between conventional methods and a method proposed by this invention. It is seen from the figure that the oxide descaling speed achieved by this invention is the highest at 11 seconds. When the pickling speed is determined for each method, with the total pickling tank length set to 93 meters, this invention realizes a high speed of 500 m/min. By elongating the length of the pickling tank (i.e. by prolonging the time that the steel strip is immersed in the acid), the conventional methods also can achieve the high speed of 500 m/min. For example, the length of the acid-washing tank in the case of the fastest conventional method is 108 m and that of the catenary method 166 m. Such long pickling tanks, however, will lead to an increased cost of acid-treatment facility and deteriorated working environments.

Figure 4:
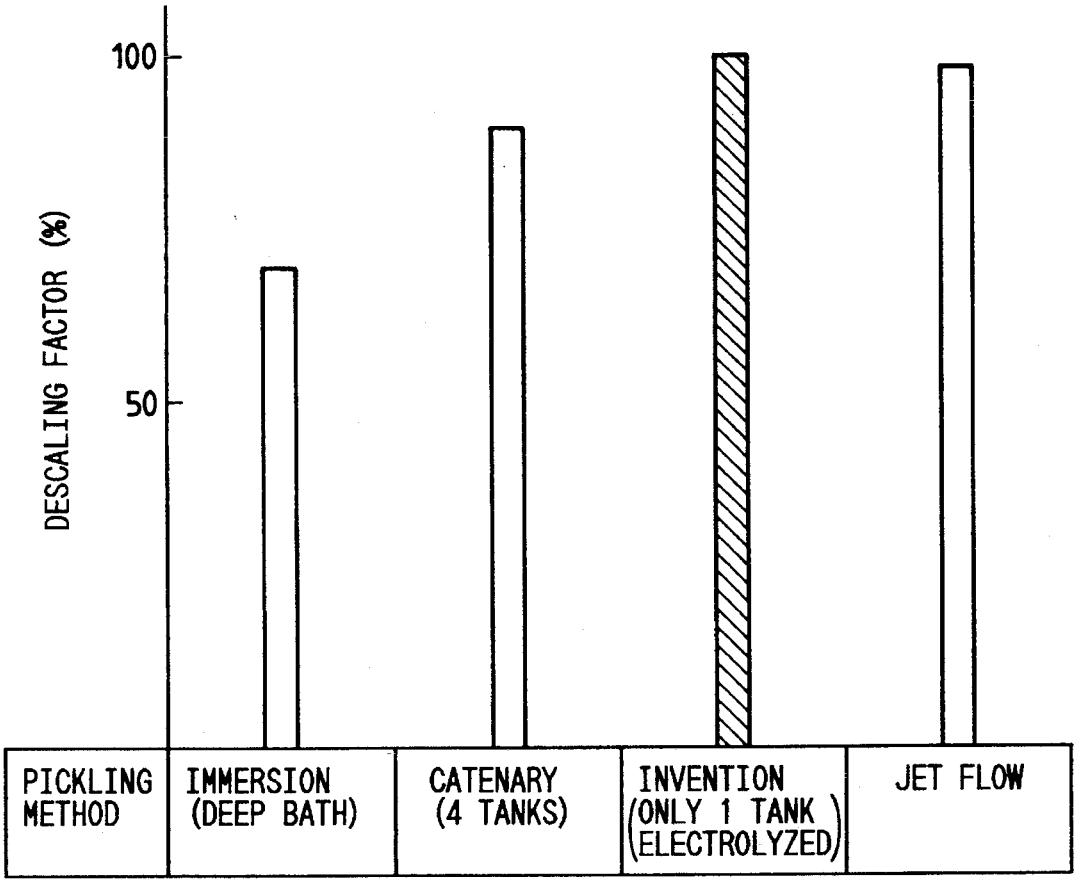
FIG. 4 is a graph showing comparison between the high-speed descaling factors of this invention and the conventional method.

FIG. 4 shows the oxide scale removing factors achieved by the conventional methods and the method of this invention, with the pickling tank length set to 95 m and the pickling speed (steel strip feeding speed) to 500 m/min. Table 1 represents the oxide scale removing state and the surface condition of the steel strip, as achieved by the methods of this invention, under the same test conditions. With such a high-speed feeding speed, the conventional methods could not remove the oxide scales perfectly and produced clouded or rough surfaces after descaling operation. On the contrary, the methods of this invention achieved complete removal of oxide scales and secured smooth surfaces when the pickling was performed at high speed of 500 m/min. The electrolysis was carried out with the current density of 10 A/dm$^2$.

The electrolysis performed in this invention requires only electrodes and associated devices to be mounted on the conventional pickling tank, and therefore this invention can improve pickling performance at low cost.

Table 1 shows the oxide scale removing states and the surface conditions of steel strips, achieved by the methods of this invention with different arrangements of ten electrodes installed in the first tank—of which five are cathode electrodes and five are anode electrodes. As the electrolysis condition, the current density was 10 A/dm$^2$ and the acid-washing speed was 500 m/min. In either case, as shown in Table 2, the oxide scale removing state was good with no rough surface, i.e. smooth surfaces were obtained with almost equal surface roughness to that obtained by the catenary method which has a low feeding speed.

TABLE 1

| No. | Electrode arrangement: Upstream side | | | | | Downstream side | | | | | Scale removing state | Remarks |
|---|---|---|---|---|---|---|---|---|---|---|---|---|
| 1 | − | − | − | − | − | + | + | + | + | + | Completely removed | Surface not roughened |
| 2 | − | − | − | − | + | + | + | − | + | + | Completely removed | Surface not roughened |
| 3 | − | − | + | − | − | − | − | + | + | + | Completely removed | Surface not roughened |
| 4 | − | + | − | − | + | − | + | − | + | + | Completely removed | Surface not roughened |
| 5 | + | + | + | + | + | − | − | − | − | − | Completely removed | Surface roughened |
| 6 | + | + | + | + | − | − | − | + | − | − | Completely removed | Surface roughened |
| 7 | + | + | − | + | − | + | + | − | − | − | Completely removed | Surface roughened |
| 8 | + | − | + | + | − | + | − | + | − | − | Completely removed | Surface roughened |

As shown in Table 1, in contrast to No. 1 to 4 of this embodiment in which anode electrodes are arranged on the downstream side and cathode electrodes on the upstream side, No. 5 to 8 with a reversed electrode arrangement produced slightly roughened surfaces though the scales were completely removed, their surface roughness being worse than that realized by the catenary method. Thus, a better surface quality is obtained by increasing the number of anode electrodes toward the downstream side, as in the case of No. 1 to 4 of this embodiment. Similar results are obtained when the area or length of the anode electrode is increased. It is preferred to accelerate the iron dissolution on the upstream side and scale dissolution on the downstream side.

Embodiment 2

Figure 5:
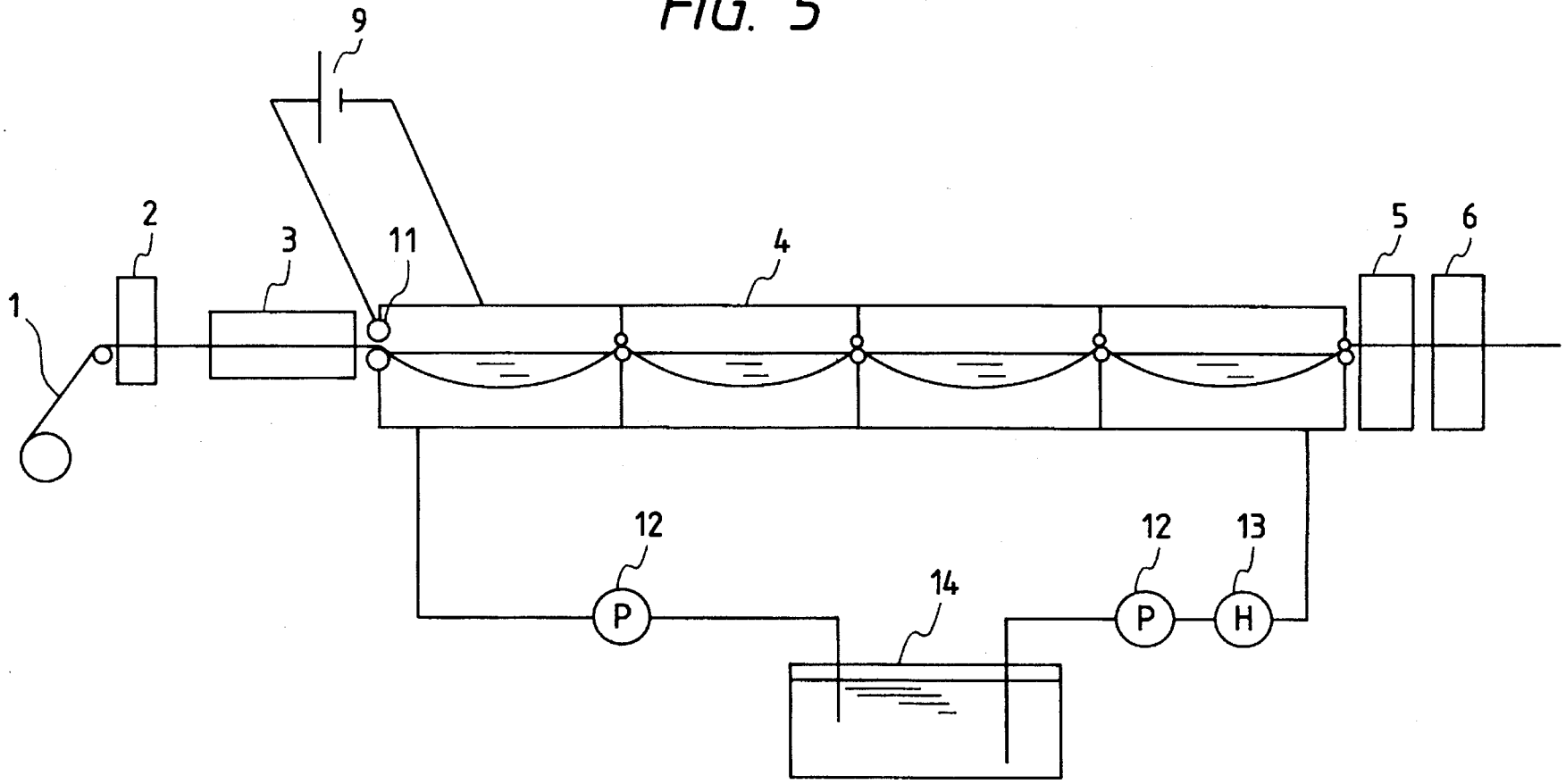
FIG. 5 is a schematic diagram showing a descaling process as another embodiment of this invention.

FIG. 5 shows another example embodying the oxide scale removing method for hot-rolled steel strips according to this invention. Unlike the first embodiment, this embodiment concerns an oxide scale removing method using a direct current application technique in which the steel strip 1 is used as an electrode in the electrolysis process. The hot-rolled steel strip 1 having oxide scales formed on the surface thereof during the hot-rolling process is introduced into an pickling bath made up of four tanks containing hydrochloric acid. As in the first embodiment, the first tank has the hydrochloric acid concentration of 1.5% and the temperature of 70° C., the second tank 3% and 95° C., the third tank 5% and 95° C., and the fourth tank 7% and 95° C. At the point where the steel strip 1 enters the first tank, a current application rolls 11 are provided. A DC current is applied between the current application rollers 11 and the acid-washing bath 4. When the current direction is set so that the steel strip is an anode, the pickling bath 4 is a cathode. In this case, although the first tank is not given an insulation treatment such as rubber lining, it is prevented from being corroded by the acid because the first tank work as a cathode. In the case of direct application of current, the acid-washing bath 4 cannot be made an anode from the viewpoint of corrosion protection for the pickling bath 4. Because the electric current passes directly through the steel strip, the current does not flow directly between the electrodes, thus significantly improving the current efficiency. This method also offers another advantage that the joule heat that raises the liquid temperature obviates the need for a heat source for heating the solution.

Figure 6:
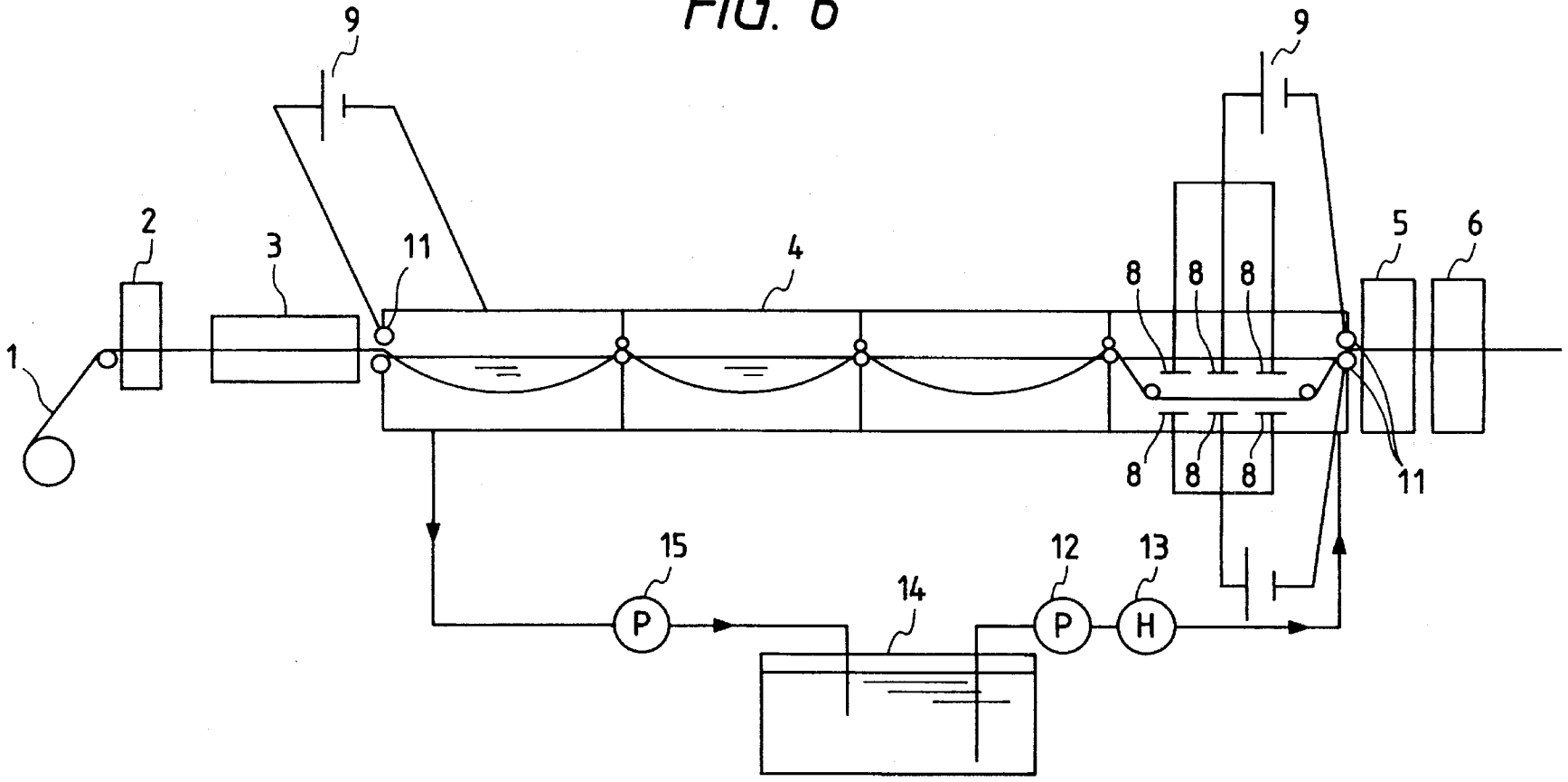
FIG. 6 is a schematic diagram showing a descaling process as a further embodiment of this invention.

This embodiment exhibited a performance almost identical with that of the apparatus described in the Embodiment 1, as shown in Table 2. As shown in FIG. 6, it is also possible to install anode electrodes in the tanks located in the latter stage of the pickling process and to apply an electric current between the steel strip and the anode electrodes, with the steel strip 1 working as a cathode, in order to improve the oxide scale removing efficiency in the latter stage of the pickling process and prevent the surface of the steel strip from being roughened.

TABLE 2

| Embodiment No. | Pickling method | Decision of descaling result | Remarks |
|---|---|---|---|
| Embodiment 1 | Steel strip feeding speed: 500 m/min; pickling bath length: 93 m (in total); 1st tank: electrolysis; 2nd–4th tank: immersion in acid (catenary) | Excellent | |
| Embodiment 2 | Steel strip feeding speed: 500 m/min; pickling bath length: 93 m (in total); 1st tank: electrolysis; 2nd–4th tank: immersion in acid (catenary) | Excellent | |
| Comparison example 1 | Steel strip feeding speed: 500 m/min; pickling bath length: 93 m (in total); 1st–4th tank: acid jet flow (catenary) | Good | Rough surface |
| Comparison example 2 | Steel strip feeding speed: 500 m/min; pickling bath length: 93 m (in total); 1st–4th tank: immersion in acid (catenary) | Poor | |
| Comparison example 3 | Steel strip feeding speed: 500 m/min; pickling bath length: 93 m (in total); immersion in acid (deep bath) | Bad | |

Embodiment 3

FIG. 7 shows the construction of a continuous manufacturing apparatus which performs pickling and cold-rolling, successively, on hot-rolled steel strips.

Figure 7A:
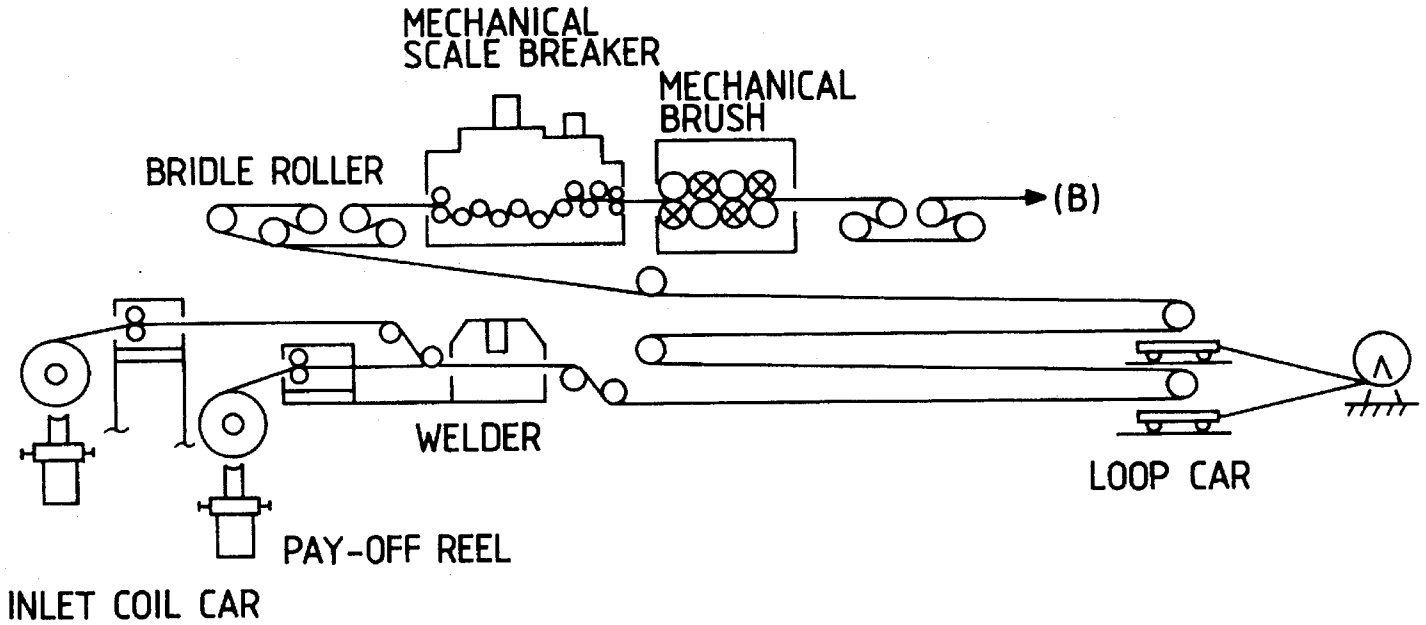
FIG. 7 is a schematic diagram showing, as one embodiment of this invention, the construction of a continuous manufacturing equipment that performs descaling and cold-rolling in a continuous sequence.

In FIG. 7(A), the steel strips wound on inlet coil cars are joined together by a welder and fed out continuously. Then, scales formed on the steel strip are cracked by bridle rollers. The steel strip is then fed to a mechanical scale breaker, in which it is passed through small-diameter rollers to peel scales off the steel strip, which is further scraped by mechanical brushes to remove scales adhering to the surface of the strip. The steel strip is then fed to the pickling apparatus shown in FIG. 7(B).

Figure 7B:
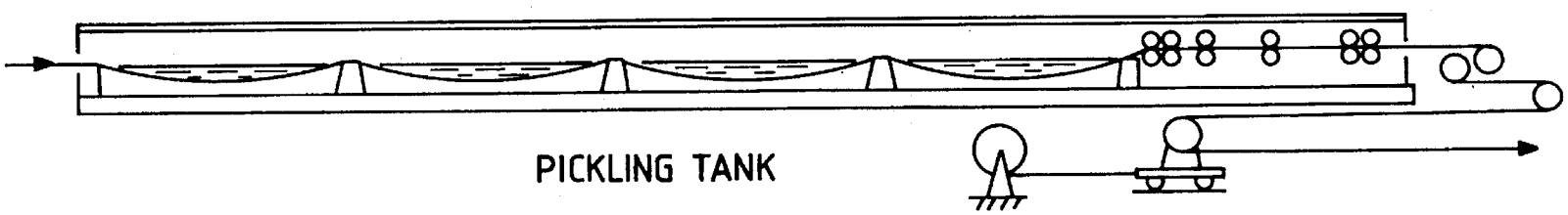

The pickling apparatus of FIG. 7(B) is the one described in the first embodiment or second embodiment. Because the descaling in this embodiment can be performed at high pickling speed of more than 500 m/min, as mentioned before, this pickling process can be directly followed by the cold-rolling process shown in FIG. 7(C).

Figure 7C:
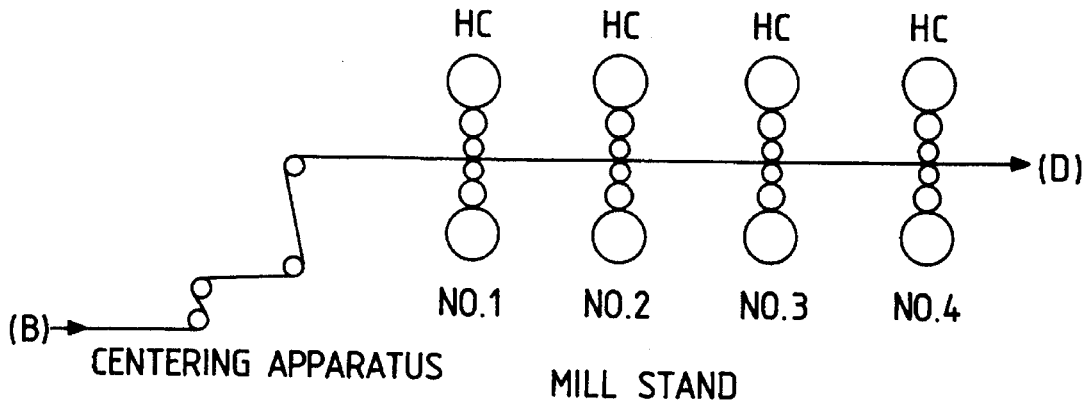

As shown in FIG. 7(C), the pickled steel strip is passed through a centering apparatus and fed to an HC mill where it is rolled into a thin sheet by four mill stands arranged in tandem. The HC mill has an intermediate roll between a backup roll and a work roll so that the intermediate rolls can be moved in opposite directions, left or right, along their axes to make the thickness of the sheet being rolled uniform. The cold-rolling machines used in this embodiment include a UC mill, CVC mill and cross mill. They may be used in combination. For example, one combination may use the HC mill as a front stand and the UC mill as a rear stand; another may use the CVC mill as a front stand and he HC mill as a rear stand, and still another may use the cross mill as a front stand and the HC mill as a rear stand.

A further speedup of rolling is possible by using a composite roll in combination with the work roll, intermediate roll and backup roll in this embodiment. The composite roll consists of a shaft member and an outer layer formed over the shaft member and containing a fine carbide. The outer layer is formed by welding a high alloy steel having higher wear resistance than the shaft member onto the surface of the shaft member by an electroslag build-up welding. The shaft member uses an alloy steel containing, by weight, 0.2–1.5% carbon, 3% or less silicon, 2% or less manganese and 5% or less chromium, or one further including 0.5% or less nickel and 1% or less molybdenum. The outer layer is formed of a high alloy steel containing 0.5–1.5% carbon, 3% or less silicon, 2% or less manganese, 2–10% chromium, 1–10% molybdenum, 20% tungsten, 1–5% vanadium, and 13% cobalt. The outer layer was subjected to a low-frequency surface heating quenching, followed by another quenching whereby it was forcibly cooled rapidly, and then was subjected to tempering so that the Hs hardness would be 80 or higher.

Rolls with Hs hardness of 80 or higher are used as work rolls. The alloy elements are adjusted so that the intermediate rolls have a smaller hardness than the work rolls and that the hardness of the backup rolls is smaller than that of the intermediate rolls. It is advised that the Hs hardnesses of these rolls be reduced by 5–10. Each mill consists of four or six stages of roll. The work roll and the intermediate roll have the same diameter but the backup roll has a greater diameter.

Figure 7D:
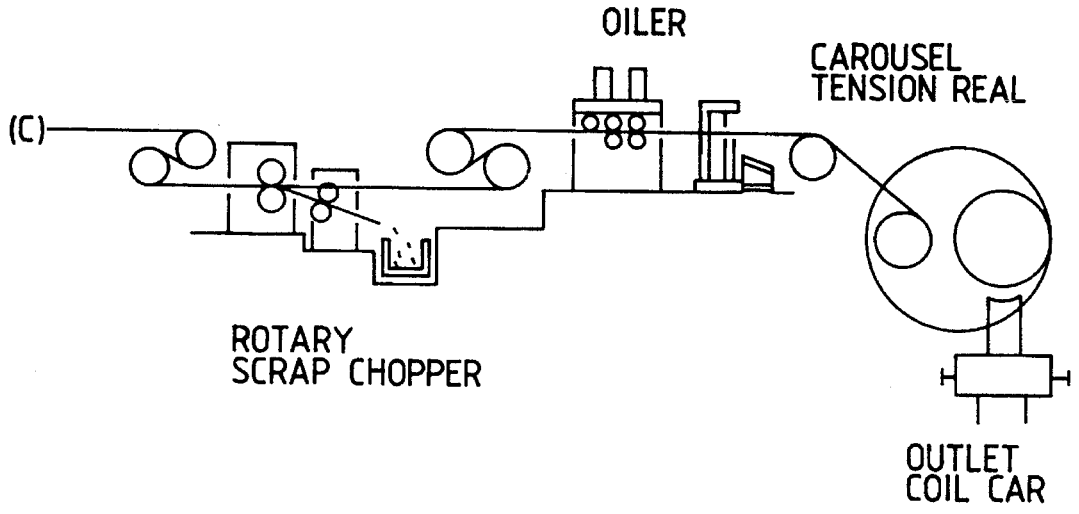

FIG. 7(D) shows the construction of an outlet coil car that winds the cold-rolled steel strip. The steel strip is cut to appropriate lengths by a rotary scrap chopper and transferred through an oiler to a carousel tension reel on which it is wound.

With this embodiment also, the steel strip can be completely removed of the scales with no roughened surface, as in Embodiment 1.

Figure 8:
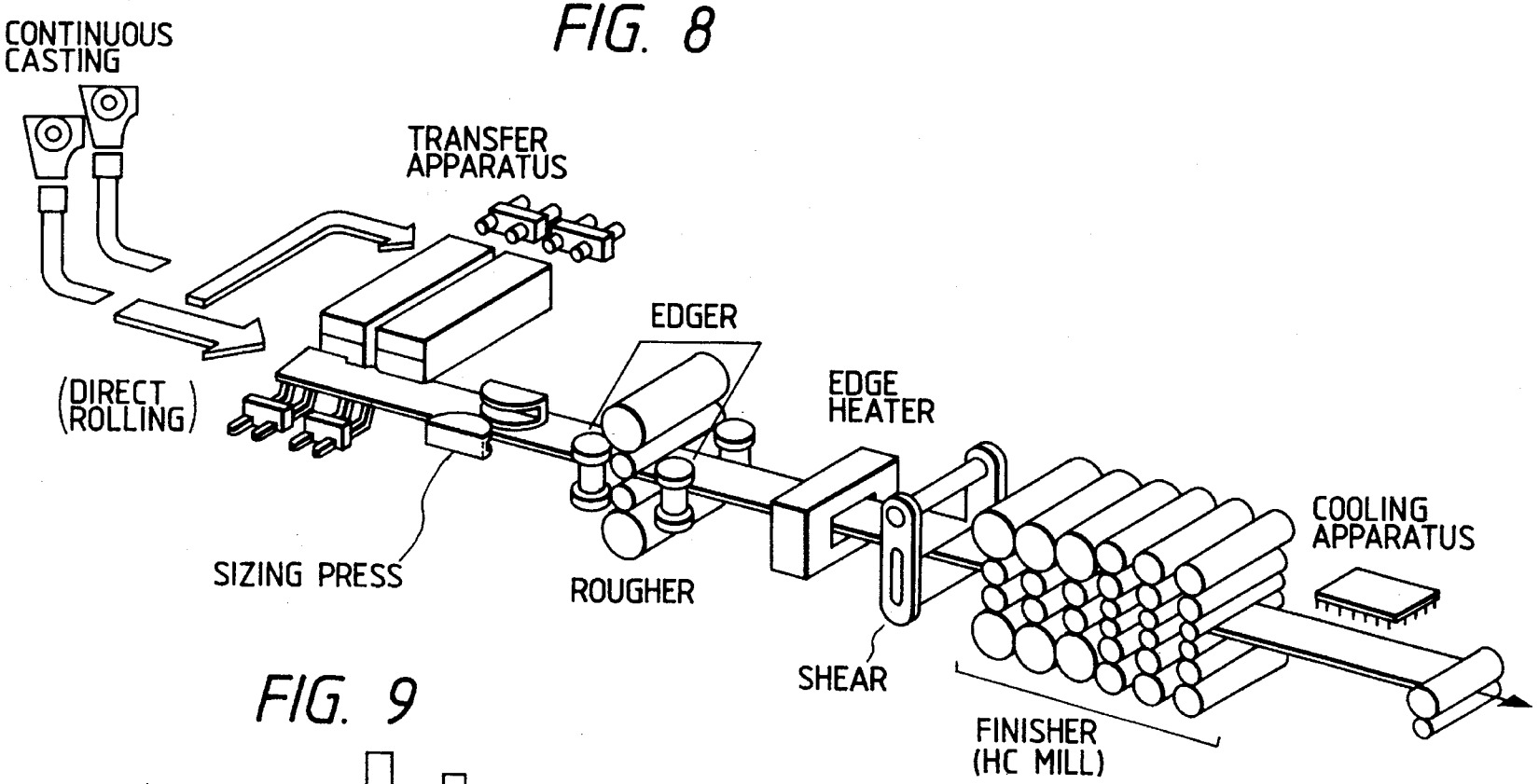
FIG. 8 is a schematic diagram showing, as one embodiment of this invention, the construction of a continuous manufacturing equipment that performs continuous casting and hot-rolling in a continuous sequence.
Figure 9:
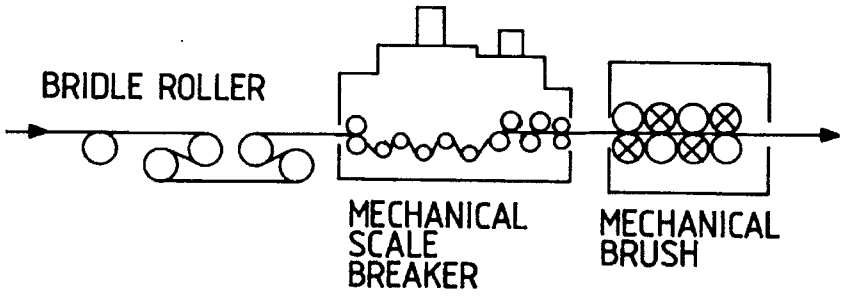
FIG. 9 is a schematic diagram showing a mechanical descaling apparatus as one embodiment of this invention.

FIG. 8 shows the construction of a continuous manufacturing apparatus which performs hot-rolling, following the continuous casting. Because two continuous casting apparatuses are used alternately to continuously manufacture a thin sheet metal about 20– 40 mm thick, the sheet is directly hot-rolled without being cooled. The continuously cast thin sheets are alternately fed to the rolling machine through a transfer apparatus. The thin sheets thus fed are passed through an edger, heated by an edge heater, cut by a shear, and hot-rolled by the HC mill. The hot-rolled sheets are passed through a cooling apparatus where they are cooled, and then transferred through the bridle rollers, mechanical scale breaker and mechanical brush shown in FIG. 9 and to the pickling apparatus shown in figures from 7(B) forward. When the feed speed in the continuous casting equipment is slower than the pickling speed, the steel strip, after being hot-rolled, is transferred through the cooling apparatus and wound by the carousel tension reel, after which the steel strip undergoes the pickling process shown in Embodiment 3.

This embodiment also produces a product completely removed of scales with no rough surface, as in the first embodiment.

The continuous casting machine in this embodiment may use a method wherein a molten metal is poured into a mold with side molds provided between the cooled steel plate belts, or a method wherein side molds are provided between the wide molds and vibrated in the direction of casting to cast thin sheets at high speed. The work rolls may use the composite rolls shown in Embodiment 3.

In this embodiment, the steel strip, after being hot-rolled, is descaled by pickling and then wound up. By omitting the winding of the steel strip in the above embodiment, it is possible to integrate the apparatuses of FIG. 7(C) and 7(D) of Embodiment 3 and a hot-rolling and winding apparatus into a continuous manufacturing equipment that performs in a continuous sequence the continuous casting, hot-rolling, mechanical descaling, pickling, cold-rolling, and winding. This integrated equipment allows a manufacture with higher efficiency.

It is also possible, in the initial stage of pickling, to install cathode electrodes in the pickling tank, apply an electric current between the steel strip and the cathodes, with the steel strip 1 serving as an anode. In FIG. 5, it is possible to provide electrodes in the first tank for indirect current application and, in FIG. 6, electrodes in the first and fourth tanks for indirect current application.

What is claimed is:

1. A method for producing a hot-rolled steel strip, in which a mild steel is rolled by a hot-rolling machine and a rolled steel strip is brought into contact with an acid solution to remove scales formed on the surface of the rolled steel strip, the hot-rolled steel strip producing method comprising the steps of:

keeping at more than 60° C. a dilute hydrochloric acid solution contained in a plurality of pickling tanks into which the steel strip coming out of the rolling machine is fed;

moving the dilute hydrochloric acid solution from downstream to upstream side of the strip feed;

supplying an electric current to the steel strip; and moving the steel strip from upstream to downstream side of the tank to pickle the steel strip.

2. A method for producing a hot-rolled steel strip according to claim 1, wherein an electric current is applied to the steel strip in a pickling tank situated on the upstream side.

3. A method for producing a hot-rolled steel strip according to claim 1, wherein an electric current is applied to the steel strip moving through a pickling tank containing the lowest-temperature dilute hydrochloric acid solution.

4. A method for producing a hot-rolled steel strip according to claim 3, wherein the dilute hydrochloric acid solution is forcibly moved and at the same time an electric current is applied to the both sides of the steel strip being fed.

5. A method for producing a hot-rolled steel strip according to claim 1, wherein the dilute hydrochloric acid solution is forcibly moved and at the same time an electric current is applied to the both sides of the steel strip being fed.

6. A method for producing a hot-rolled steel strip according to claim 5, wherein an electric current is applied to the both sides of the steel strip at the current density of 5–10 $A/dm^2$.

7. A method for producing a hot-rolled steel strip according to claim 1, wherein before or after the acid solution is forcibly moved over the both sides of the steel strip, an electric current is applied to the steel strip.

8. A method for producing a hot-rolled steel strip according to claim 2, wherein the dilute hydrochloric acid solution is forcibly moved and at the same time an electric current is applied to the both sides of the steel strip being fed.

9. A method for descaling a hot-rolled steel strip by pickling, comprising the steps of:

keeping a dilute hydrochloric acid solution contained in a plurality of pickling tanks at more than 60° C.;

moving the dilute hydrochloric acid solution from downstream to upstream side of the strip;

supplying an electric current to the steel strip; and moving the steel strip from upstream to downstream side of the tank to pickle the steel strip.

10. A method for descaling hot-rolled steel strips according to claim 9, wherein an electric current is passed through the steel strip in a pickling tank situated on the upstream side.

11. A method for descaling a hot-rolled steel strip according to claim 10, wherein an electric current is applied to the steel strip moving through a pickling tank containing the lowest-temperature dilute hydrochloric acid solution.

12. A method for descaling a hot-rolled steel strip according to claim 9, wherein an electric current is applied to the steel strip moving through a pickling tank containing the lowest-temperature dilute hydrochloric acid solution.

13. A method for descaling a hot-rolled steel strip according to claim 12, wherein the dilute hydrochloric acid solution is forcibly moved and at the same time an electric current is applied to the both sides of the steel strip being fed.

14. A method for descaling a hot-rolled steel strip according to claim 9, wherein the dilute hydrochloric acid solution is forcibly moved and at the same time an electric current is applied to the both sides of the steel strip being fed.

15. A method for descaling a hot-rolled steel strip according to claim 14, wherein an electric current is applied to the both sides of the steel strip at the current density of 5–10 $A/dm^2$.

16. A method for descaling a hot-rolled steel strip according to claim 9, wherein before or after the acid solution is forcibly moved over the both sides of the steel strip, an electric current is applied to the steel strip.

17. A hot-rolled steel strip descaling apparatus for descaling hot-rolled steel strips by pickling, comprising:

a plurality of pickling tanks for containing a dilute hydrochloric acid solution kept at 60° C. or higher;

a means to move the dilute hydrochloric acid solution from downstream to upstream side of the strip feed;

a means to move the steel strip from upstream to downstream side of the tank; and a means to apply an electric current to the steel strip.

18. A hot-rolled steel strip descaling apparatus according to claim 17, wherein in a continuous pickling apparatus for hot-rolled steel strips, a means is provided to apply an electric current to the steel strip being fed.

19. A hot-rolled steel strip descaling apparatus according to claim 18, wherein the pickling tank is provided with a cathode and an electric current indirectly to the steel strip being fed.

20. A hot-rolled steel strip descaling apparatus according to claim 18, wherein a cathode or an anode is installed facing the steel strip, the steel strip is made to serve as an anode or a cathode, and a means is provided to apply an electric current directly to the steel strip being fed.

21. A hot-rolled steel strip descaling apparatus according to claim 17, wherein the pickling tank is provided with a cathode and an anode and a means is provided to apply an electric current indirectly to the steel strip being fed.

22. A hot-rolled steel strip descaling apparatus according to claim 21, wherein a cathode or an anode is installed facing the steel strip, the steel strip is made to serve as an anode or a cathode, and a means is provided to apply an electric current directly to the steel strip being fed.

23. A hot-rolled steel strip descaling apparatus according to claim 17, wherein a cathode or an anode is installed facing the steel strip, the steel strip is made to serve as an anode or a cathode, and a means is provided to apply an electric current directly to the steel strip being fed.

24. A hot-rolled steel strip descaling apparatus according to claim 23, wherein a last electrode in each tank that the steel strip passes is an anode.

25. A hot-rolled steel strip descaling apparatus according to claim 25, wherein at least one of area, length and number of anodes in the electrode that the steel strip passes increases toward the downstream side of the pickling process.

26. A hot-rolled steel strip descaling apparatus comprising:

a means to feed a steel strip rolled by a hot-rolling machine;

a means to cut the steel strip to arbitrary lengths;

a means to apply mechanical stresses to scales formed on the steel strip;

a plurality of tanks for storing an acid solution that comes into contact with the steel strip;

a means to immerse and feed the steel strip through the acid solution in the plurality of tanks;

a means to heat the acid solution to more than 60° C.;

a means to move the acid solution from downstream to upstream side of the steel strip feed;

a means to apply an electric current to the steel strip;

a means to water-wash the treated steel strip that has come out of the tank; and a means to dry the water-washed steel strip.

27. A hot-rolled steel strip descaling apparatus according to claim 26, wherein the current application means is provided on the upstream side of the steel strip feed.

28. A hot-rolled steel strip descaling apparatus according to claim 27, wherein the heating means and the acid solution moving means are provided in a system bypassing from the group of tanks.

29. A hot-rolled steel strip descaling apparatus according to claim 26, wherein the heating means and the acid solution moving means are provided in a system bypassing from the group of tanks.

30. A method for producing a hot-rolled steel strip, in which a mild steel is rolled by a hot-rolling machine and a rolled steel strip is brought into contact with an acid solution to remove scales formed on the surface of the rolled steel strip, the hot-rolled steel strip manufacturing method comprising the steps of:

mechanically removing scales from the surface of the steel strip coming out of the rolling machine;

immersing the steel strip in a plurality of pickling tanks containing a dilute hydrochloric acid solution;

moving the dilute hydrochloric acid solution from downstream to upstream side of the steel strip feed;

applying an electric current to the steel strip; and moving the steel strip from upstream to downstream side of the tank to pickle the steel strip.

31. A method for descaling hot-rolled steel strips by pickling, a continuous manufacturing method for descaling and cold-rolling hot-rolled steel strips, comprising the steps of:

mechanically removing scales from the surface of the hot-rolled steel strip;

immersing the steel strip in a plurality of pickling tanks containing a dilute hydrochloric acid solution;

moving the dilute hydrochloric acid solution from downstream to upstream side of the steel strip feed;

applying an electric current to the steel strip;

moving the steel strip from upstream to downstream side of the tank to pickle the steel strip; and cold-rolling the pickled steel strip.

32. A continuous manufacturing method for descaling and rolling steel strips, comprising the steps of:

making a mild steel thin sheet casting by a continuous casting machine;

rolling the thin sheet into a steel strip by a hot-rolling machine;

mechanically removing scales from the surface of the hot-rolled steel strip;

immersing the steel strip in a plurality of pickling tanks containing a dilute hydrochloric acid solution;

moving the dilute hydrochloric acid solution from downstream to upstream side of the steel strip feed;

applying an electric current to the steel strip; moving the steel strip from upstream to downstream side of the tank to pickle the steel strip; and cold-rolling the pickled steel strip.

33. A continuous manufacturing apparatus for descaling and cold-rolling hot-rolled steel strips according to claim 32, wherein the cold-rolling machine or the hot-rolling machine has a pair of work rolls, and the work rolls are composite rolls, each of which comprises a shaft member and an outer layer formed over the shaft member and having a greater hardness than that of the shaft member.

34. A apparatus for descaling hot-rolled steel strip by pickling, a continuous manufacturing apparatus for descaling and cold-rolling hot-rolled steel strips, comprising:

a mechanical scale breaker to mechanically remove scales from the surface of the hot-rolled steel strip;

a plurality of pickling tanks for containing a dilute hydrochloric acid solution;

a means to move the dilute hydrochloric acid solution from downstream to upstream side of the steel strip feed;

a means to move the steel strip from upstream to downstream side of the tank;

a means to apply an electric current to the steel strip; and a cold-rolling machine to cold-roll the pickled steel strip.

35. A continuous manufacturing apparatus for descaling and cold-rolling hot-rolled steel strips according to claim 34, wherein the cold-rolling machine or the hot-rolling machine has a pair of work rolls, and the work rolls are composite rolls, each of which comprises a shaft member and an outer layer formed over the shaft member and having a greater hardness than that of the shaft member.

36. A continuous manufacturing apparatus for rolling and descaling hot-rolled steel strips, comprising:

a hot-rolling machine;

a mechanical scale breaker to mechanically remove scales from the surface of the hot-rolled steel strip;

a plurality of pickling tanks for containg a dilute hydrochloric acid solution;

a means to immerse and feed the descaled steel strip through the acid solution when in the plurality of tanks;

a means to heat the acid solution;

a means to move the acid solution from downstream to upstream side of the steel strip feed;

a means to apply an electric current to the steel strip;

a means to water-wash the treated steel strip coming out of the tanks; and a means to dry the water-washed steel strip.

37. A continuous manufacturing apparatus for rolling and descaling steel strips, comprising:

a continuous casting machine to make a mild steel thin sheet casting;

a hot-rolling machine to hot-roll the thin sheet casting;

a mechanical scale breaker to mechanically remove scales from the surface of the hot-rolled steel strip;

a plurality of pickling tanks for containing a dilute hydrochloric acid solution;

a means to immerse and feed the descaled steel strip through the acid solution when in the plurality of tanks;

a means to heat the acid solution;

a means to move the acid solution from downstream to upstream side of the steel strip feed;

a means to apply an electric current to the steel strip;

a means to water-wash the treated steel strip coming out of the tanks;

a means to dry the water-washed steel strip; and a cold-rolling machine to cold-roll the dried steel strip.

* * * * *